United States Patent [19]

Haag et al.

[11] 4,072,917

[45] Feb. 7, 1978

[54] SWITCH ACTUATING HINGE

[75] Inventors: Michael Haag, Chicago; Herman P. Pichler, Franklin Park, both of Ill.

[73] Assignee: Rixson-Firemark, Inc., Franklin Park, Ill.

[21] Appl. No.: 673,603

[22] Filed: Apr. 5, 1976

[51] Int. Cl.[2] ..... H01H 9/00

[52] U.S. Cl. ..... 335/205; 200/61.7

[58] Field of Search ..... 335/153, 205; 200/61.62, 61.7, 61.82

[56] References Cited

U.S. PATENT DOCUMENTS

| | | | |
|---|---|---|---|
| 3,806,852 | 4/1974 | Suska | 200/61.7 X |
| 3,852,692 | 12/1974 | Moorman | 335/205 |
| 3,896,404 | 7/1975 | Peterson | 200/61.7 X |

*Primary Examiner*—George Harris

[57] ABSTRACT

A pivot hinge comprising a reed switch embedded in the leaf of a nonmagnetic pivot-jamb portion. The reed switch is located in the jamb leaf at an attitude to miss the mounting holes. A round permanent magnet is adjustably mounted on the pivot-door portion perpendicular to the door leaf. When both the door and jamb leaves are together, the magnet is positioned over the reed switch contacts. A threaded, nonmagnetic rod (adjusting screw) with a head the shape of a mounting screw is positioned adjacent the magnet in a mounting hole of the door leaf and retained in position by a retainer ring. The adjusting screw is, in turn, coupled to the magnet with a nonmagnetic link. When the adjusting screw is turned, the magnet can be moved closer to or away from the reed switch in order to actuate the switch with an adjustable sensitivity as indicated by a change in the degree of door opening or closing required to operate the switch.

6 Claims, 6 Drawing Figures

FIG. 1
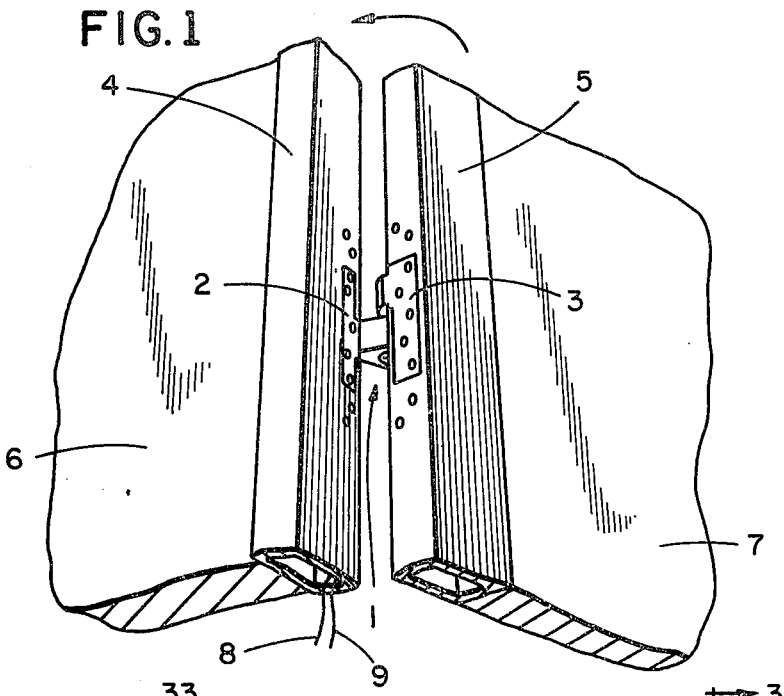
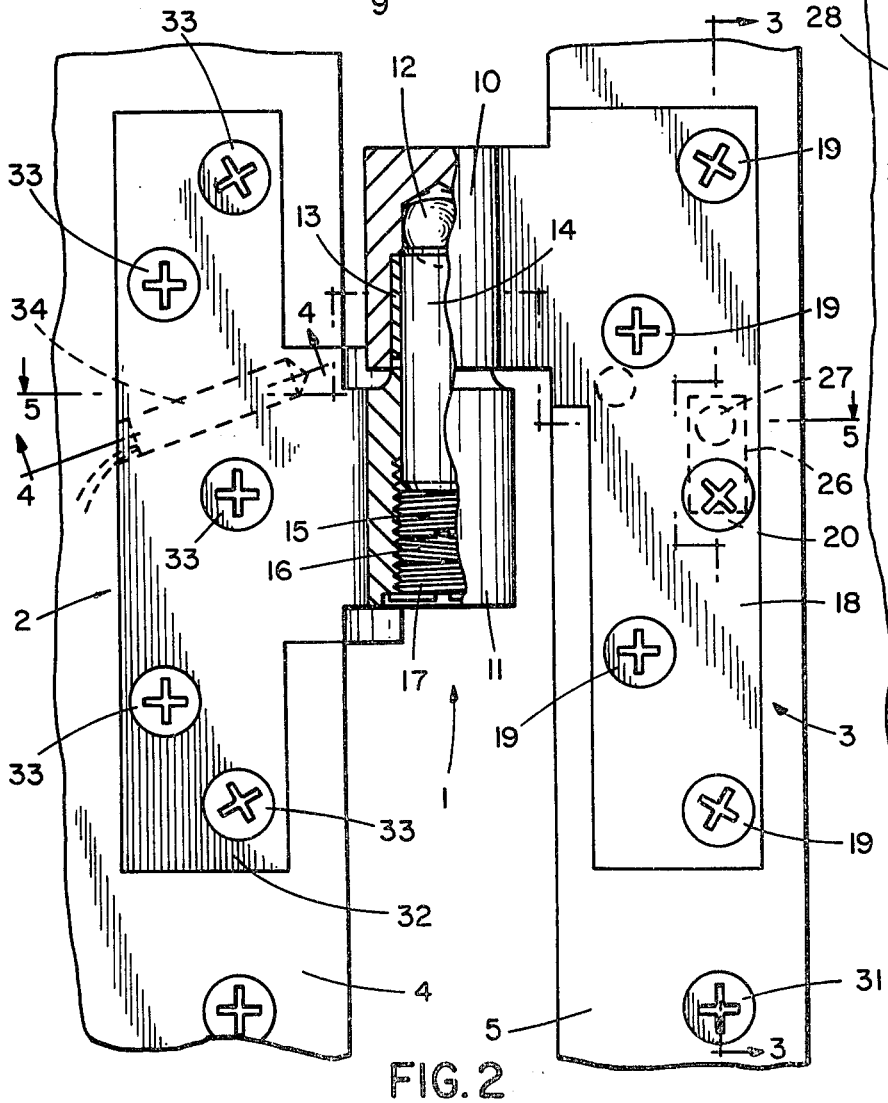
FIG. 2
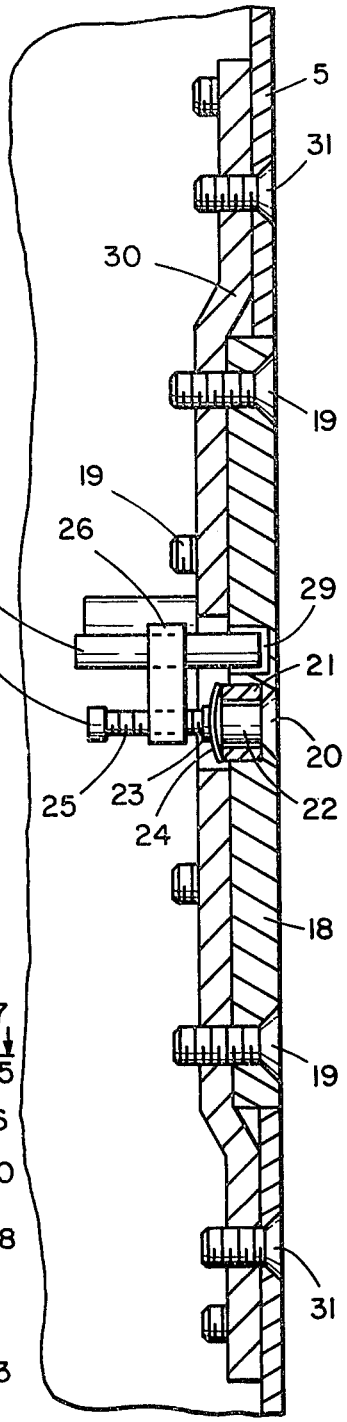
FIG. 3

SWITCH ACTUATING HINGE

BACKGROUND OF THE INVENTION

Rising crime statistics have enhanced the concern with building security and to the development of security devices and systems to protect life and property. A typical security system includes devices for monitoring the use of entrances to and within a building. Although monitoring devices may be prominently displayed to discourage casual intruders, it is preferable to conceal the devices to avoid alerting determined intruders who might then circumvent the devices.

One monitoring device known in the art utilizes a magnetically operated switch. The switch is mounted on a jamb above a door and a magnet is mounted on the upper edge of the door. The switch is either normally open or normally closed and assumes the opposite position in response to the magnet when it and the magnet are in closely spaced relation, as when the door is closed. The position of the switch is monitored, for example, by a light on a display panel connected in an electrical circuit with the switch.

With use of the arrangement described above, both the switch and the magnet are in a relatively conspicuous location and accessible to intruders; hence they may be readily disabled. Moreover, since both are additional attachments to the door and the jamb, extra installation time and mounting fixtures are required, increasing the cost of using the system.

Other monitoring devices incorporate a switch, such as a plunger or reed switch, on or in a hinge leaf, and the adjacent hinge leaf actuates the plunger or carries a permanent magnet. When the relative position of the leaves changes, the switch contacts operate to effect a desired circuit operation. U.S. Pat. Nos. 3,715,537, 3,806,852 and 3,896,404 are typical of prior art switch actuating hinges.

SUMMARY OF THE INVENTION

A principal object of this invention is to provide a switch actuating hinge in which the presence of the reed switch and its actuating magnet cannot be detected by an observer inspecting the hinge as applied to a door.

A related object is to provide for adjustment of the magnet to effect the desired switch actuating sensitivity without sacrificing the principal object of concealment and without removal of the hinge.

The foregoing objects are attained by the structure briefly described in the Abstract.

DETAILED DESCRIPTION OF THE DRAWINGS

FIG. 1 is a perspective view of a center door portion supported by an intermediate pivot which has been modified to incorporate the switching structure of this invention;

FIG. 2 is an elevation view of the intermediate pivot of FIG. 1 with a portion of the pivot knuckles being broken away and with the principal parts of the switching structure being shown in broken line;

FIG. 3 is a section view taken along line 3—3 of FIG. 2 and showing the permanent magnet adjusting structure;

DESCRIPTION OF THE PREFERRED EMBODIMENT

Figure 4:
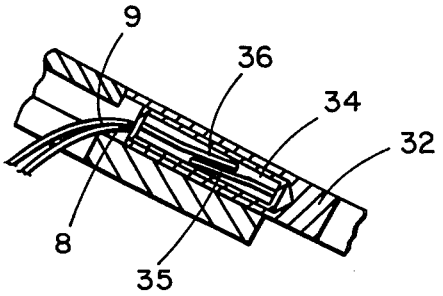
FIG. 4 is a section view taken along line 4—4 of FIG. 2 showing a typical reed switch.

Referring now to FIG. 1, the intermediate pivot 1 which comprises pivot-jamb portion 2 and pivot-door portion 3 is shown affixed to vertical jamb frame 4 and vertical door frame 5, respectively. Jamb frame 4 is rigidly fixed to wall portion 6 and door frame 5 is rigidly fixed to door 7.

Intermediate pivot 1 together with upper and lower pivots (not shown) pivotly support door 7 with respect to wall 6. When door 7 is moved in the direction of arrow so as to effect door closing, a magnet carried and supported by the pivot-door portion 3 actuates a reed switch supported and carried by pivot-jamb portion 2 so as to ffect a desired switching operation. Conductors 8 and 9 passing through the internal cavity of jamb frame 4 are appropriately connected to circuitry (not shown) to effect a desired operation.

As is shown in FIG. 2, knuckle 10 which is a part of pivot-door portion 3, is pivotly supported on knuckle 11 which is a part of pivot-jamb portion 2. Knuckle 10 is formed with a stapped bore which houses a spherical ball bearing 12, a cylindrical sleeve bearing 13 and the upper portion of pivot pin 14. Sleeve bearing 13 is pressfit within the bore of knuckle 10 so that it cannot rotate. Similarly, pivot pin 14 is keyed (by means now shown) to knuckle 11 so that the pin cannot rotate relative the wall portions of knuckle 11.

Slotted adjusting screw 15 mates with the internal threads located within bore 16 of knuckle 11. Vertical adjustment of this screw produces a corresponding vertical adjustment in pivot pin 14 so that knuckle 10 may be raised and lowered relative knuckle 11 for proper hinge adjustment. Threaded cap 17 closes the lower end of bore 16 so as to seal adjusting screw 15 and the other internal components located within the aligned bores of knuckles 10 and 11.

Hinge leaf 18 which is integrally formed with knuckle 10 is affixed to the adjacent edge of door frame 5 by a plurality of mounting screws 19.

A threaded, nonmagnetic rod (adjusting screw) 20 with a head having a shape exactly the same as that of mounting screws 19, is positioned within a mounting screw hole located in door leaf 18. Accordingly, adjusting screw 20 cannot be distinguished from any of mounting screws 19 when hinge leaf 18 is fastened to door 7.

As is shown in FIG. 3, adjusting screw 20 passes through a bore located within door leaf 18. A nonmagnetic bushing 21 is pressfit into a bore so as to envelope a shank portion 22 of adjusting screw 20. A second shank portion 23 of adjusting screw 20 is formed with a groove (not shown) which receives retainer ring or clip 24. This clip locks adjusting screw 20 in position relative door leaf 18.

The central portion 25 of adjusting screw 20 is threaded and this threaded portion carries a nonmagnetic link 26. The upper portion of nonmagnetic link 26 is formed with a bore through which a cylindrical rod magnet 27 is housed. Rotational adjustment of screw 20 causes link 26 to move along the threaded shaft portion 25. This movement of link 26 causes a corresponding movement in rod magnet 27. The movement to the left of link 26 is limited by stop 28 affixed to the threaded shank portion 25. It should be noted that the right end of magnet 27 is located within a recess 29 formed in jamb leaf 18. Recess 29 is cylindrical in shape and has a diameter somewhat larger than the diamter of magnet 27. In any event, link 26 hits stop 28 before the right extremity of magnet 27 is removed from the recess 29. Accordingly, rotation of adjusting screw 20 does not effect a corresponding rotation in rod magnet 27, but rather causes rod magnet 27 to reciprocate on its longitudinal axis so as to protrude more or less within recess 29 as required.

As is shown in FIG. 3, door leaf 18 is affixed to door frame 5 by means of a back mounting strap 30. Mounting screws 31, in addition to mounting screws 19, effect a coupling of components 5, 18 and 30.

Jamb leaf 32 is affixed to jamb frame 4 by a plurality of mounting screws 33.

Figure 5:
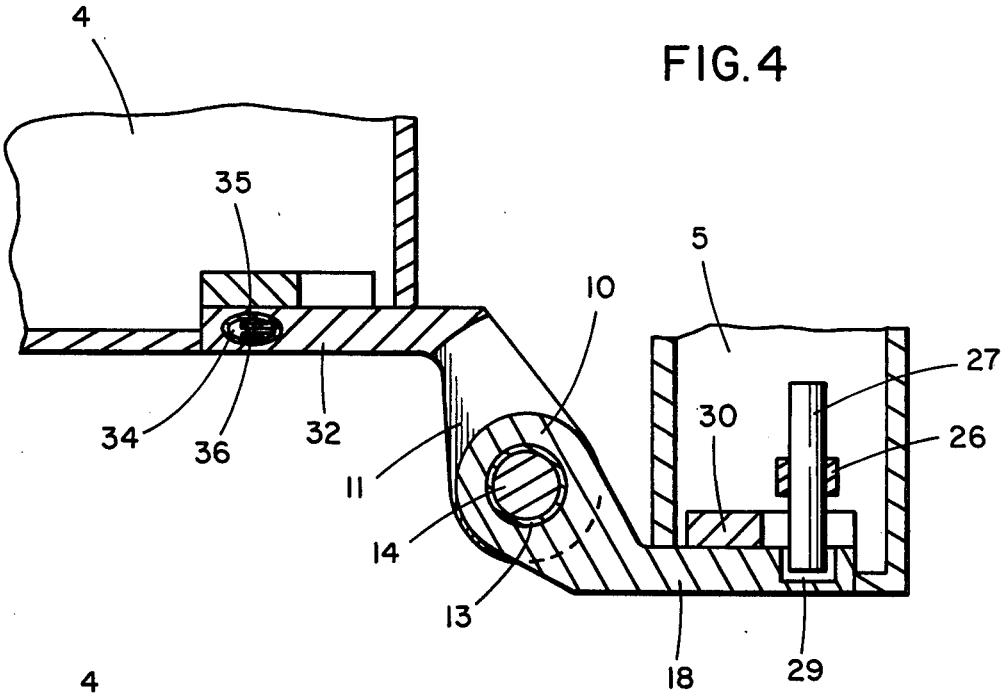
FIG. 5 is a section view taken along line 5—5 of FIG. 4 showing the permanent magnet rod and the reed switch contacts.

As is shown (in broken line) in FIG. 2, FIG. 4, and FIG. 5, a normally-open, single-pole, reed switch 34 is inserted within a recess formed in jamb leaf 32. Reed switch 34 is of conventional construction and can have any number and configuration of reeds so as to effect the type of switching operation required for a particular application. For the sake of simplicity, in the present specification a normally-open, single-pole, reed structure involving reeds 35 and 36 is described. External electrical connection is made to reeds 35 and 36 by means of conductors 8 and 9 which connect to terminals which pass through the reed envelope.

Figure 6:
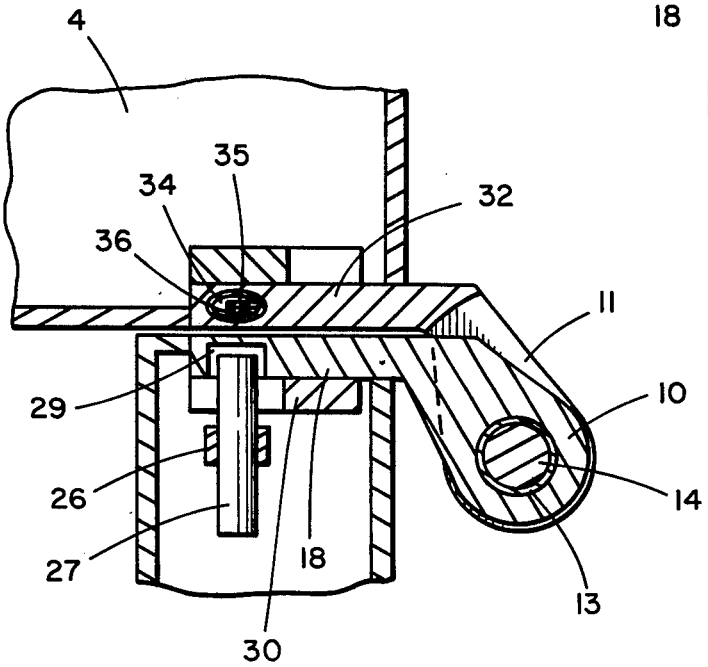
FIG. 6 is a view related to that of FIG. 5 with the hinge leaves closed to show closing of the reed switch contacts.

Reed switch 34 is so aligned within jamb leaf 32 that when the leaves 18 and 32 are closed as is shown in FIG. 6, rod magnet 27 is sufficiently close to the reeds of the switch that closure is effected as is shown in FIG. 6. With this occurrence, a closed circuit is effected by connecting to conductors 8 and 9. However, in the event that leaves 28 and 32 are opened as is shown in FIG. 5, magnet 27 is removed from the vicinity of reed switch 34 and the individual reeds 35 and 36 open as is shown in this Figure. Accordingly, an open circuit is presented to conductors 8 and 9.

It should be noted that leaves 18 and 32 should preferably be fabricated of nonmagnetic metals, otherwise the magnetic lines of force of magnet 27 will be incapable of actuating reed switch 34.

The sensitivity of the switching structure may be altered by rotating adjusting screw 20. If this rotation is in such a direction as to increase the gap between the upper end of magnet 27 (FIG. 6) and reeds 35, 36, but still effecting contact closing, the sensitivity of the switch is increased. That is, with the larger gap. slight door opening movements will cause the contacts to open. Conversely, if the gap is decreased, sensitivity will also be decreased. A larger door opening movement will be required to cause the contacts to open.

In view of the fact that switch 34 is embedded in leaf 32 with conductors 8, 9 hidden within the jamb channel, and the head of adjusting screw 20 is identical to the mounting screw heads 19, the presence of the inge activated switch of this invention cannot be detected.

It should be understood that the above described embodiment is merely illustrative of the principles of this invention, and that modifications can be made without departing from the scope of the invention.

What is claimed is:

1. In a switch actuating hinge in which the hinge has a door leaf and a jamb leaf both having mounting screw holes with each hole adapted to receive the head of an associated mounting screw, the improvement comprising a magnet actuated switch carried by the jamb leaf, a permanent magnet carried by the door leaf, an adjusting screw retained within one of the door leaf mounting holes and having a head substantially identical to that of the mounting screws, and means coupling the adjusting screw to the magnet whereby adjustment of the screw from the exposed face of the door leaf when mounted effects the relative positioning of the magnet and the switch with a resultant change in switch actuating sensitivity.

2. The combination of claim 1 in which the switch is a magnetic reed switch.

3. The combination of claim 2 in which the reed switch is embedded within the jamb leaf.

4. The combination of claim 2 in which the magnet is elongated and in which the adjusting screw moves the magnet on its longitudinal axis.

5. The combination of claim 4 in which the adjusting screw is elongated and the longitudinal axis of the screw and magnet are parallel.

6. The combination of claim 5 in which the coupling means is a nonmagnetic link fixed to the magnet and coupled by threads to the screw.

* * * * *